United States Patent [19]

Sawa et al.

[11] Patent Number: 4,567,715

[45] Date of Patent: Feb. 4, 1986

[54] PACKING DEVICE

[75] Inventors: Yuji Sawa; Toshio Itoh, both of Fukushima, Japan

[73] Assignee: Kureha Kagaku Kogyo Kabushiki Kaisha, Tokyo, Japan

[21] Appl. No.: 450,663

[22] Filed: Dec. 17, 1982

[30] Foreign Application Priority Data

Dec. 18, 1981 [JP] Japan ..... 56-205938
Dec. 18, 1981 [JP] Japan ..... 56-190124[U]

[51] Int. Cl.[4] ..... B65B 43/36

[52] U.S. Cl. ..... 53/572; 53/384; 53/385

[58] Field of Search ..... 53/572, 385, 386, 384

[56] References Cited

U.S. PATENT DOCUMENTS

| | | | |
|---|---|---|---|
| 2,770,084 | 11/1956 | Ruderman | 53/572 |
| 3,059,390 | 10/1962 | Handzel | 53/572 |
| 3,391,519 | 7/1968 | Keenan, Jr. et al. | 53/572 |
| 3,412,522 | 11/1968 | Schorer | 53/572 |
| 3,492,780 | 2/1970 | Bastasch | 53/572 |
| 3,552,090 | 1/1971 | Roberts et al. | 53/71 |
| 3,587,843 | 6/1971 | Wing | 206/57 |
| 3,619,969 | 11/1971 | Holcombe | 53/29 |
| 3,763,628 | 10/1973 | Bodolay | 53/572 |
| 3,916,603 | 11/1975 | Kristiansen | 53/384 |
| 3,965,654 | 6/1976 | Reubens et al. | 53/572 |
| 4,032,038 | 6/1977 | Hendricks et al. | 221/71 |
| 4,245,944 | 1/1981 | van Ginkel et al. | 53/572 |
| 4,377,929 | 3/1983 | Altenpohl et al. | 53/572 |

*Primary Examiner*—Lowell A. Larson
*Attorney, Agent, or Firm*—Woodcock Washburn Kurtz Mackiewicz & Norris

[57] ABSTRACT

An improved packing device is disclosed which features an upwardly biased bag table for receiving a stack of plastic bags. A press member holds down the uppermost of the stack of bags at its mouth end. A pickup device is brought into engagement with the upper surface of the uppermost bag of the stack as the pressure of the uppermost bag against the press member is momentarily reduced, so that the pickup member is enabled to pull out the top surface of the bag from under the press member. The lower surface of the uppermost bag is then retained by the press member so that a blower supplying air to the end of the mouth of the bag to open it fully does not cause the bag to be blown away.

9 Claims, 23 Drawing Figures

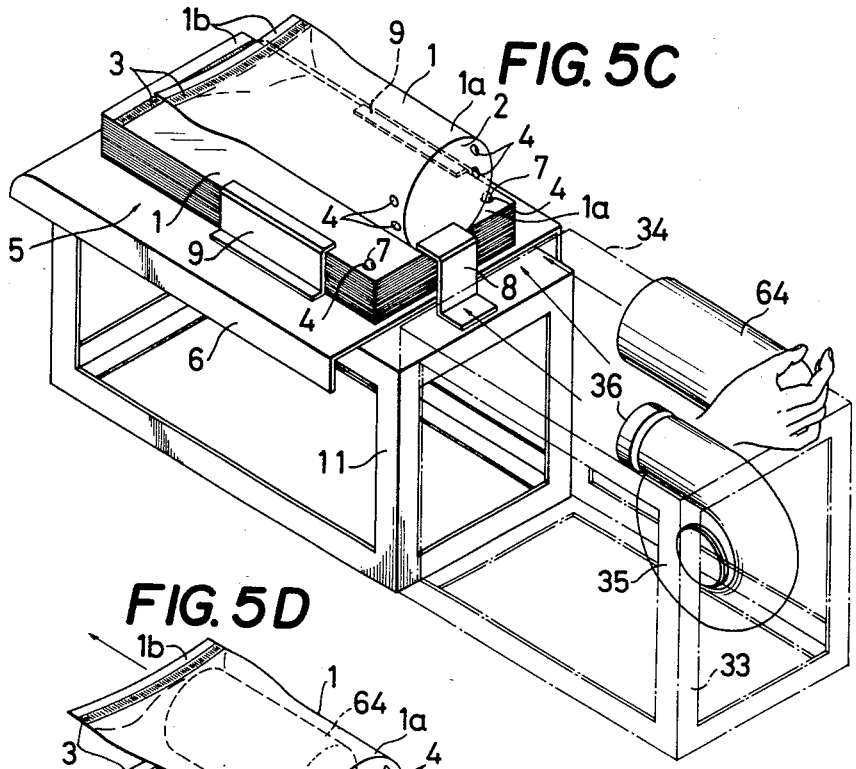
FIG. 5C
FIG. 5D
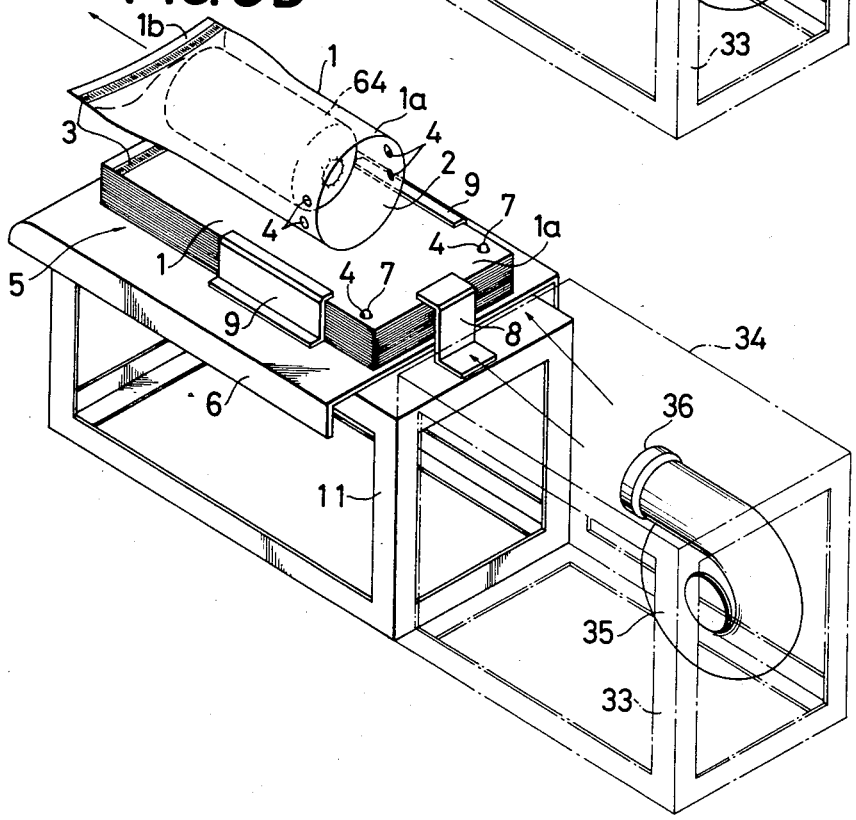

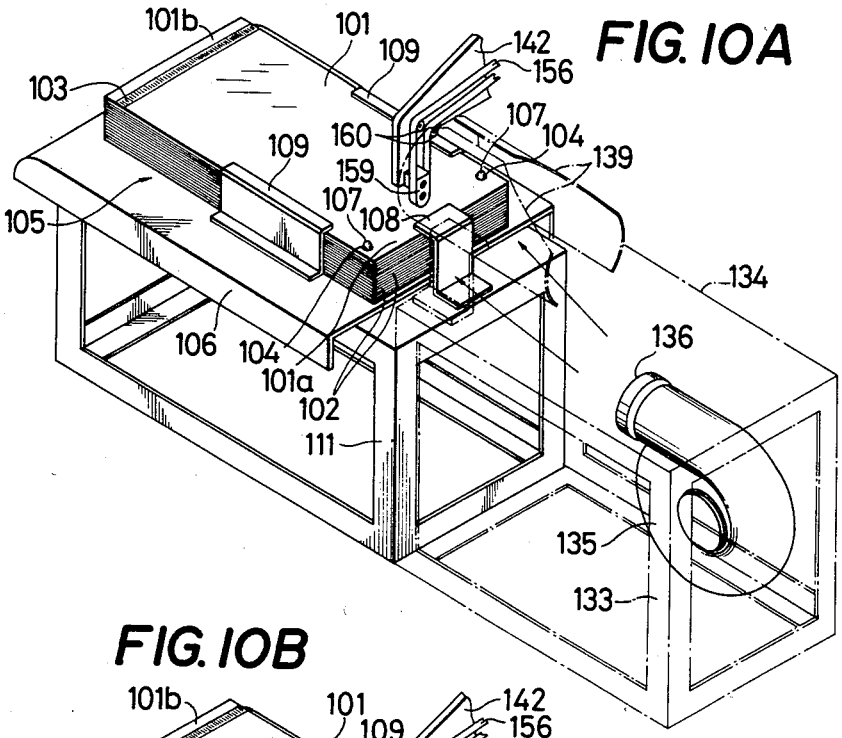
FIG. 10A
FIG. 10B
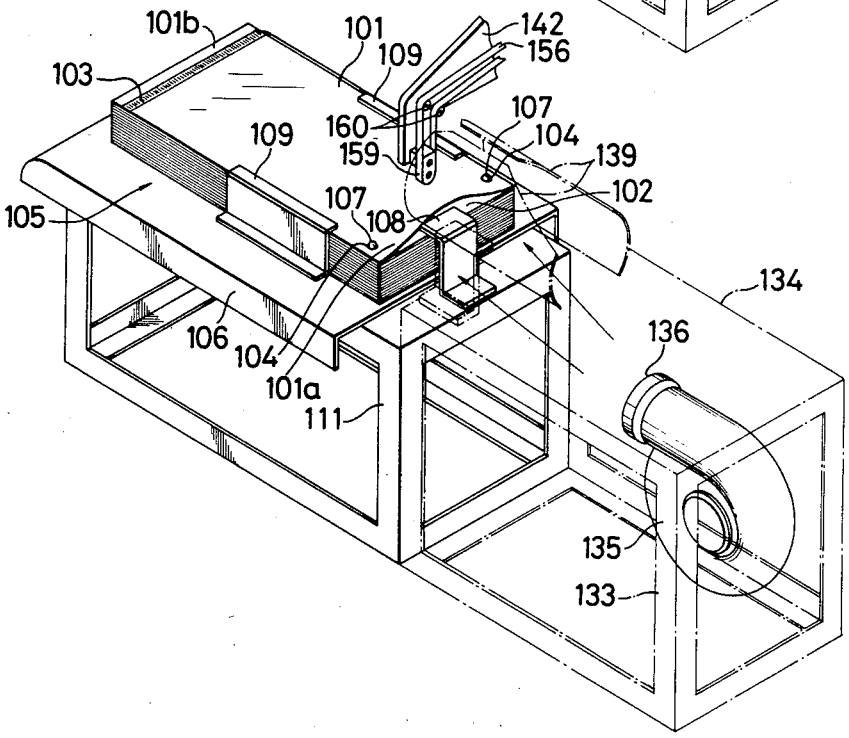

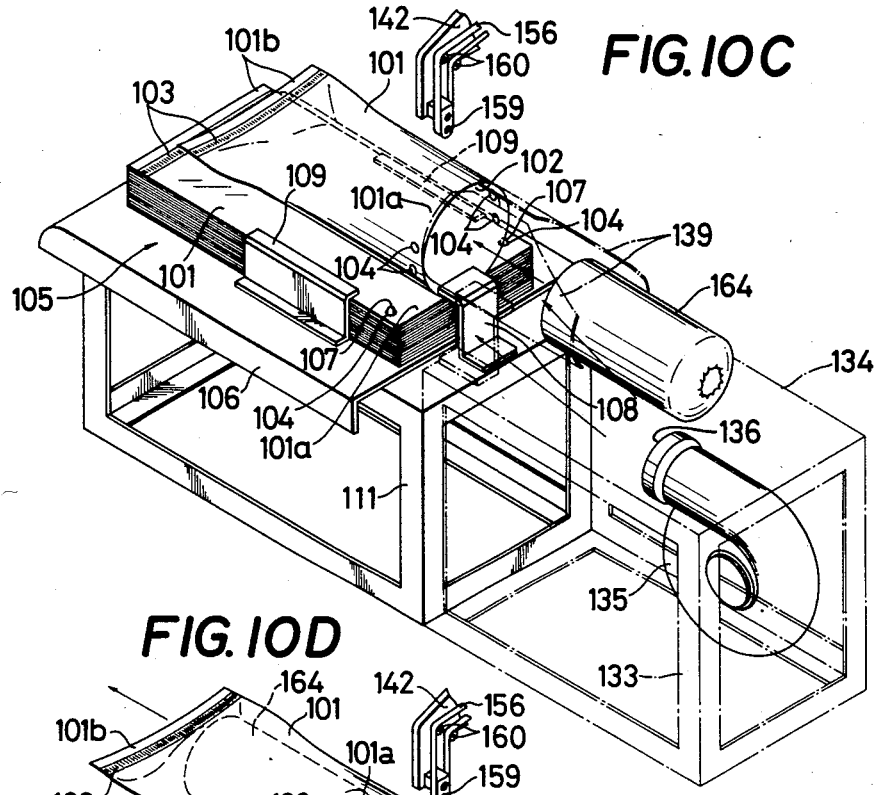
FIG. 10C
FIG. 10D
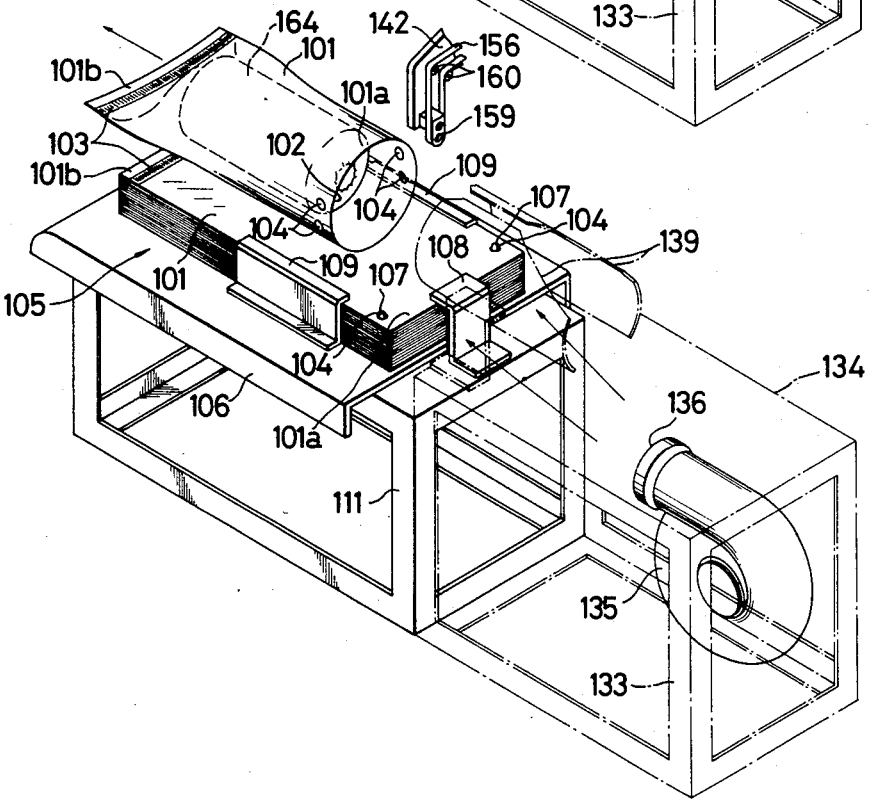

PACKING DEVICE

BACKGROUND OF THE INVENTION

1. Field of the Invention

The present invention relates to a packing device suitably adapted for filling and packing solid articles such as pieces of ham into plastic film bags or the like, wherein a unit of piled bags is used, each having a mouth or opening at one end and being sealed at the other end, such that the plastic bags are sequentially picked up and automatically opened at the mouth to be filled with ham or the like.

2. Description of the Prior Art

A packing device as described above has already been proposed by the same applicant. According to these prior art techniques, the uppermost plastic bag of the unit of piled bags is picked up by an adhesive tape which is used as a pickup means. Thereafter, the picked up plastic bag is transferred to a position where it is inflated with air. The mouth of the plastic bag is thus opened. These prior art techniques have an advantage in that the plastic bag may be sequentially picked up and automatically opened at the mouth. However, when each plastic bag is picked up from the unit of piled bags, the underlying plastic bag may be picked up therewith, resulting in a pick up error. Furthermore, when the plastic bag is inflated with air to open it at the mouth, the mouth may not be successfully opened, and the plastic bag may be inadvertently separated (that is, blown away) from the pick up means. This prevents filling of the plastic bag with ham or the like. In addition, the overall packing device is bulky and complex in structure.

SUMMARY OF THE INVENTION

It is the primary object of the present invention to provide a simple packing device wherein a mouth or opening of a plastic bag may be simply and reliably opened with blown gas when an operator presses a unit of piled bags lightly downward with his hand and picks up the mouth end of the upper surface of the uppermost plastic bag between fingers of the same hand while simultaneously releasing his hand from the unit of piled bags, the inflated plastic bag with its open mouth being securely held in this state on said unit to allow subsequent filling with a solid article.

It is the secondary object of the present invention to provide a packing device which is compact in size, is very simple in construction and is low in manufacturing cost, and which uses a unit of piled bags wherein the upper surface of an uppermost plastic bag is picked up by intermittently urging a pickup means against the upper surface edge at the mouth of the plastic bag and then raising the pickup means together with the upper surface of the plastic bag, the pressure exerted by a press mechanism being temporarily attenuated during the pick up operation, so that the upper surface edge at the mouth of the plastic bag may be easily picked up from a position beneath a press portion; the pressure exerted by the press mechanism is increased again so as to prevent scattering of the piled bags by gas blown against the mouth ends of the plastic bags thereof; and the mouth of the uppermost plastic bag is opened by the blown gas during the pickup operation of its upper surface while the bag is simultaneously naturally separated from a holding means. According to the packing device of the present invention, a pickup error such as an accidental pickup of an underlying plastic bag during pickup of the uppermost plastic bag may not occur. When gas is blown against the mouth to open it, the end may be easily opened and the plastic bag may not be accidentally blown away which prevents filling of the bag with a solid article. The plastic bags may be sequentially picked up and opened at the mouth. The operation of the loader of the present invention only involves intermittent pickup of the upper surface of the uppermost plastic bag of the unit of piled bags placed at a predetermined position with a pickup means and does not involve transfer of the picked up plastic bag to different position or the like.

BRIEF DESCRIPTION OF THE DRAWINGS

FIGS. 1 to 6D show a packing device according to the first embodiment of the present invention, wherein FIG. 1 is a perspective view of a unit of piled bags and a bag table, FIG. 2, is a sectional side view of the overall device, FIG. 3 is a plan view of the overall device, FIG. 4 is a sectional view along arrows IV—IV in FIG. 3, FIGS. 5A to 5D and FIGS. 6A to 6D are respectively perspective views and sectional side views of the device for explaining the mode of operation of the device; and FIGS. 7 to 12D show a packing device according to the second embodiment of the present invention, wherein FIG. 7 is a sectional side view of the overall device, FIG. 8 is a plan view of the device shown in FIG. 7, FIG. 9 is a sectional view along arrows IX—IX in FIG. 8, FIGS. 10A to 10D and FIGS. 11A to 11D are respectively perspective views and partial sectional side views of the device for explaining the mode of operation of the device.

DETAILED DESCRIPTION OF THE PREFERRED EMBODIMENTS

A packing device according to the first embodiment of the present invention will first be described with reference to FIGS. 1 to 6D.

Figure 1:
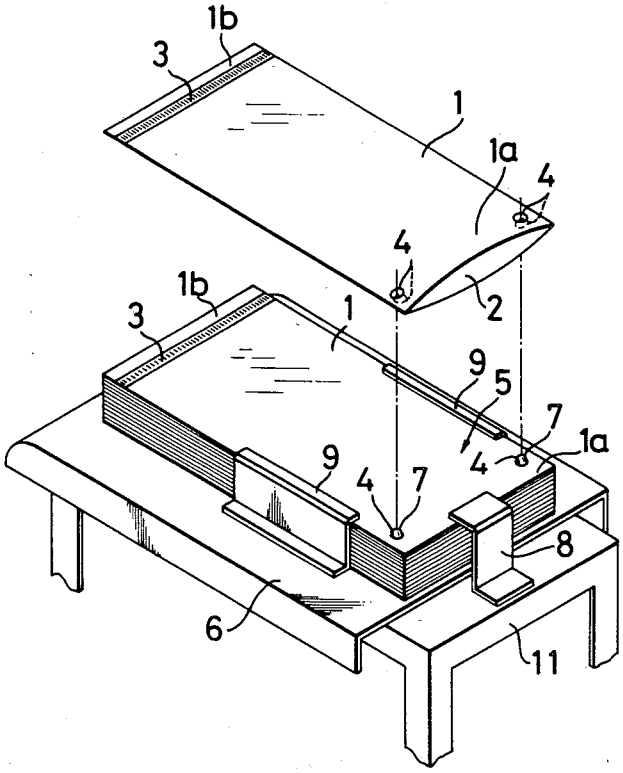

Referring to FIG. 1, a plastic bag 1 used herein consists of a plastic film and has one end 1*a* with a mouth or opening 2 and the other end 1*b* which is closed. The other end 1*b* of the plastic bag 1 may have a seal 3 formed by welding or may be tied. A pair of through holes 4 are formed at the two sides of the one end 1*a* of the plastic bag 1. A plurality of such plastic bags 1 are piled to form a unit of piled bags 5 which is placed on a bag table 6. A pair of holding pins 7 as a holding means extend vertically upward from the front end of the bag table 6 such that they extend through the through holes 4 of each of the plastic bags 1 of the unit 5 to hold each one. The substantially central part of the mouth end of the stack of plastic bags 1 of the bag cassette 5 is pressed downward by a press plate 8 as will be described later. Reference numeral 9 denotes a pair of positioning members arranged on the bag table 5; they may omitted.

Figure 4:
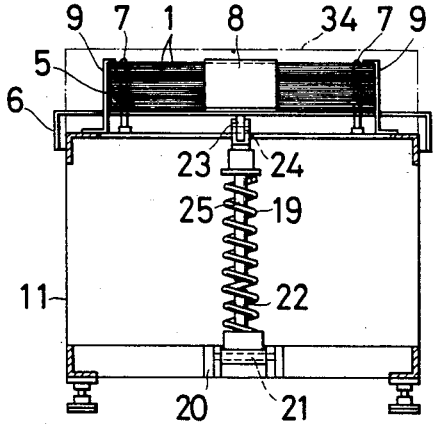
Figure 2:
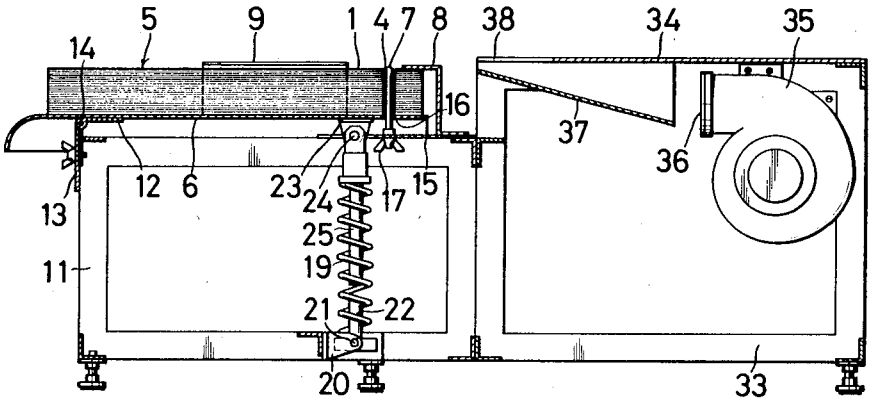
Figure 3:
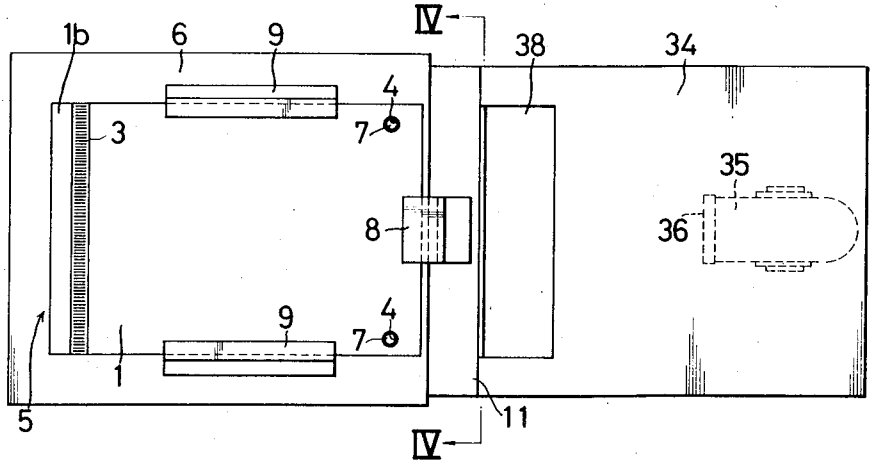

Referring to FIGS. 2 to 4, the bag table 6 is mounted on a rear frame 11. The lower surface of the rear end of the bag table 6 is mounted to a mounting portion 13 of the rear frame 11 through hinges 12. The bag table 6 pivots vertically on a pivot pin 14 of the rear frame 11. The holding pins 7 and the press plate 8 are respectively fixed to an upper horizontal plate 15 of the rear frame 11. The holding pins 7 project upward through a pair of right and left insertion holes 16 formed at the front end of the bag table 6. Adjustment screws 17 are mounted at the lower ends of the holding pins 7 so as to allow adjustment of their height.

A spring 19 as a pressing means for pressing the bag table 6 upward is arranged below the bag table 6. The lower end of the spring 19 is supported outside a support rod 22 which is pivotally supported through a pivot pin 21 on a mounting portion 20 of the rear frame 11, and the upper end is supported outside a support rod 25 which is pivotally mounted through a pivot pin 24 on a mounting portion 23 fixed to a portion of the lower surface of the bag table 6.

The upper horizontal plate 34 of a front frame 33 is fixed at the same level as that of the press plate 8. In the front frame 33, a blower 35 is mounted below the upper horizontal plate 34, and its supply opening 36 opens toward the rear. Air ejected from the supply opening 36 is guided by an air guide 37 formed below the upper horizontal plate 34. The air is then blown toward the mouths 2 of the plastic bags 1 from an opening 38 formed substantially at the center of the rear end of the upper horizontal plate 34.

The packing device of the first embodiment of the present invention has a configuration as described above. The pickup operation of each plastic bag 1 and the filling operation of each picked up plastic bag 1 with a solid article such as ham will be described with reference to FIGS. 5A to 5D and FIGS. 6A to 6D.

The unit 5 is placed on the bag table 6 and is fixed in position since the holding pins 7 are inserted through the through holes 4 of the plastic bags 1. The bag table 6 is biased upward by the biasing force of the spring 19, so that the central portions of the one ends 1*a* of the plastic bags 1 are urged upward against the lower surface of the press plate 8. Air from the blower 35 is blown toward the mouths 2 of the plastic bags 1.

Figure 5A:
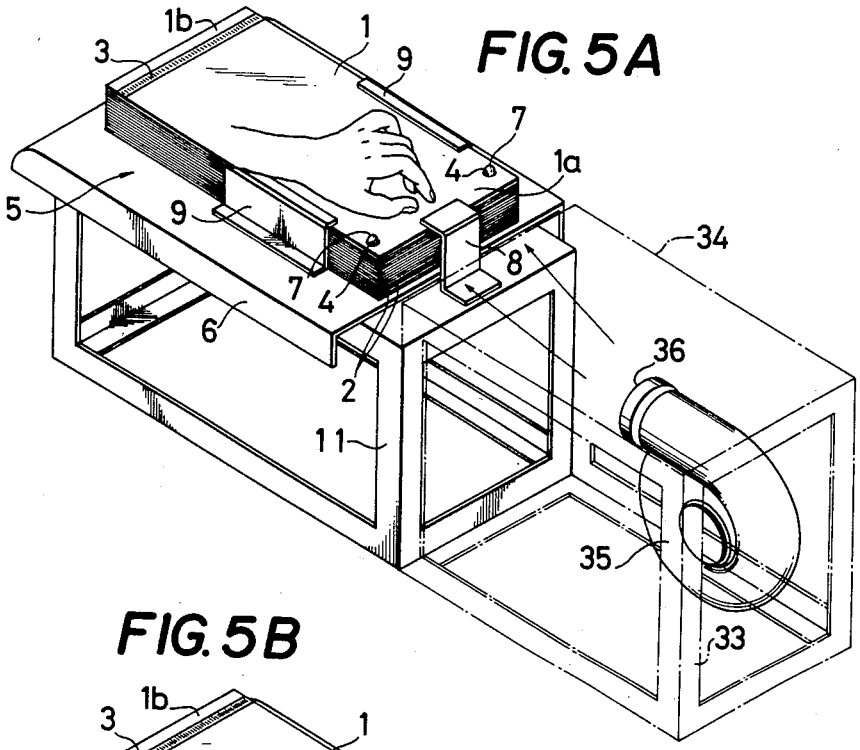
Figure 6A:
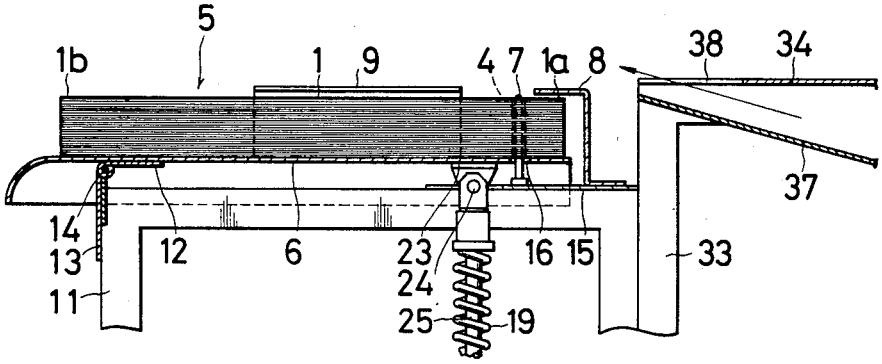

In this state, the operator presses downward the unit of piled bags with his left hand, as shown in FIG. 5A. Then, as shown in FIG. 6A, the bag table 6 descends slightly against the biasing force of the spring 19 to define a gap between the upper surface of the uppermost plastic bag 1 and the press plate 8.

Figure 5B:
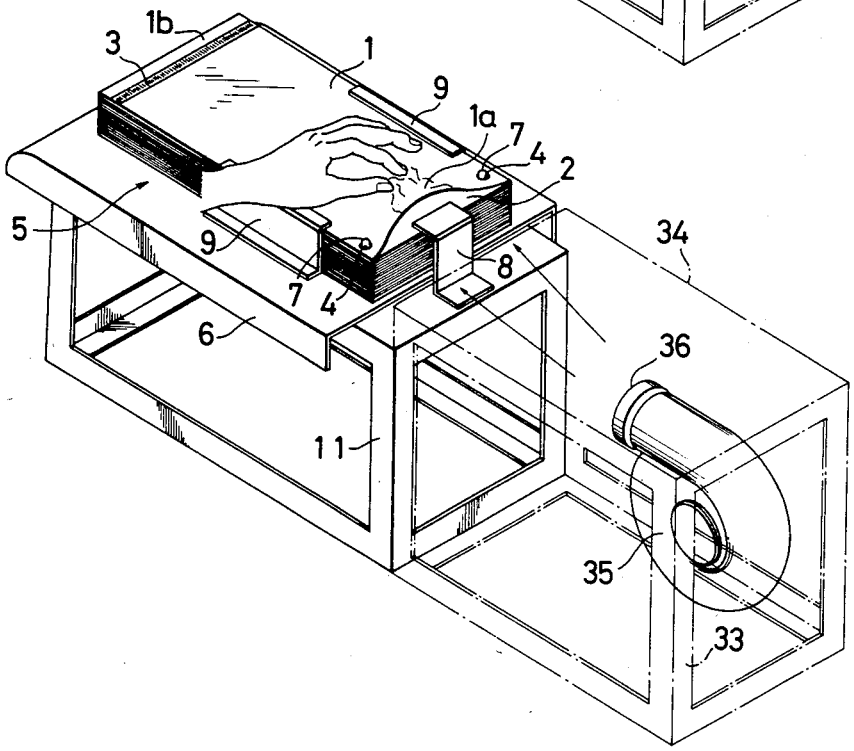
Figure 6B:
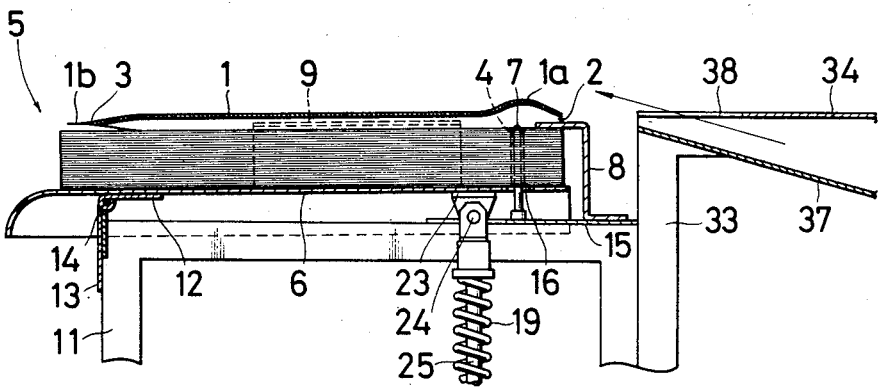

Subsequently, as shown in FIG. 5B, the operator picks up with the thumb and forefinger of his left hand the upper surface of the one end 1*a* of the uppermost plastic bag 1. Then, as shown in FIG. 6B, the upper surface of the one end 1*a* of the plastic bag 1 is easily pulled out from the gap between the upper surface of the plastic bag 1 and the press plate 8, and the mouth 2 of the plastic bag 1 Opens.

Figure 6C:
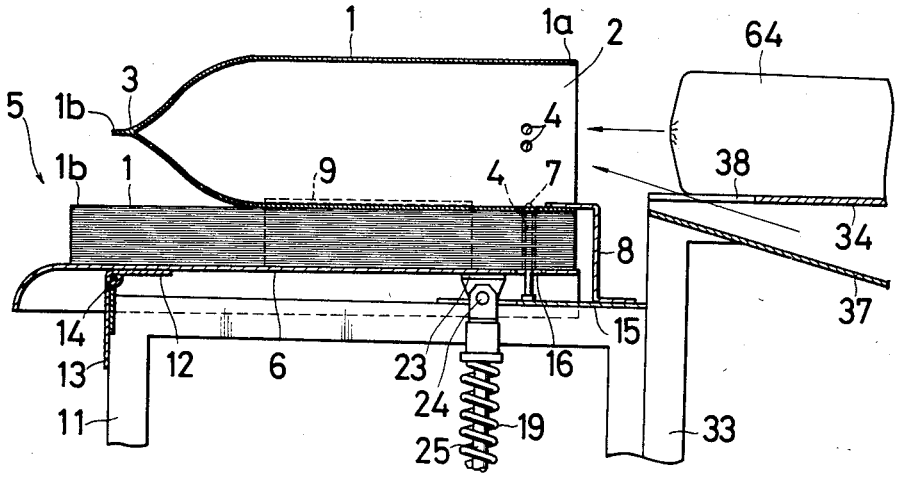

Meanwhile, air is blown toward the mouth end of the plastic bags 1 of the unit 5. Accordingly, when the upper surface of the one end 1*a* of the uppermost plastic bag 1 is manually picked up in the manner described above and the left hand is simultaneously released from the upper surface of the plastic bag 1, air is blown inside the plastic bag 1 as shown in FIGS. 5C and 6C. The plastic bag 1 is inflated with air and expands into a cylindrical shape, thus defining the mouth 2 into a circular opening at the one end 1*a*. Then, the holding pins 7 naturally disengage from the holes 4 of the plastic bag 1.

Since the bag table 6 is returned upward by the biasing force of the spring 19, the lower surface of the one end 1*a* of the uppermost plastic bag 1 and the underlying plastic bags 1 are clamped at a position beneath the lower surface of the press plate 8 and held thereby. For this reason, the uppermost plastic bag 1 is held in the expanded cylindrical shape atop the unit 5 and may not therefore be blown away by the airstream.

Figure 6D:
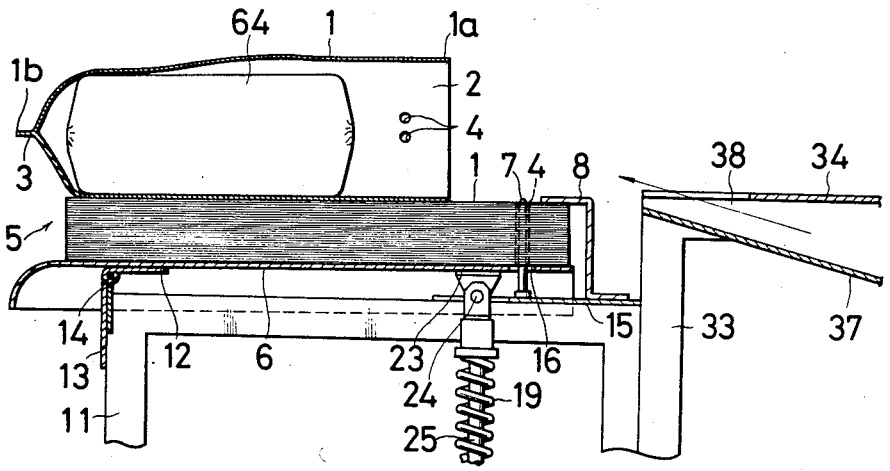

The operator can then toss with his right hand, for example, a solid article 64 such as ham into the uppermost plastic bag 1 through its mouth 2. Due to the impact thereof, the lower surface of the one end 1*a* of the uppermost plastic bag 1 is pulled out from its position beneath the press plate 8 as shown in FIG. 5D and 6D. The plastic bag 1 is then conveyed together with the solid article 64 to the next step such as a packing step.

The packing device of the first embodiment of the present invention has the configuration and the mode of operation as described above. The packing device may therefore be used alone or may be used in combination with feed-in and feed-out conveyors for ham or the like in a vacuum packing line or the like.

A packing device according to the second embodiment of the present invetnion will now be described with reference to FIGS. 7 to 11D.

Figure 7:
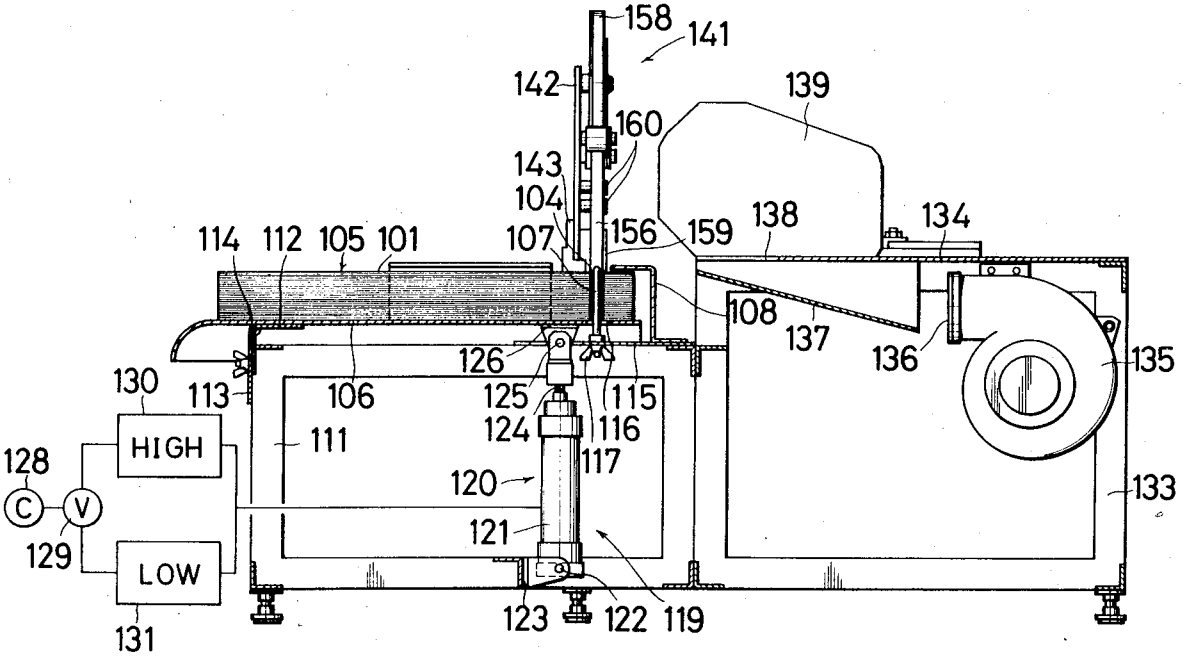
Figure 8:
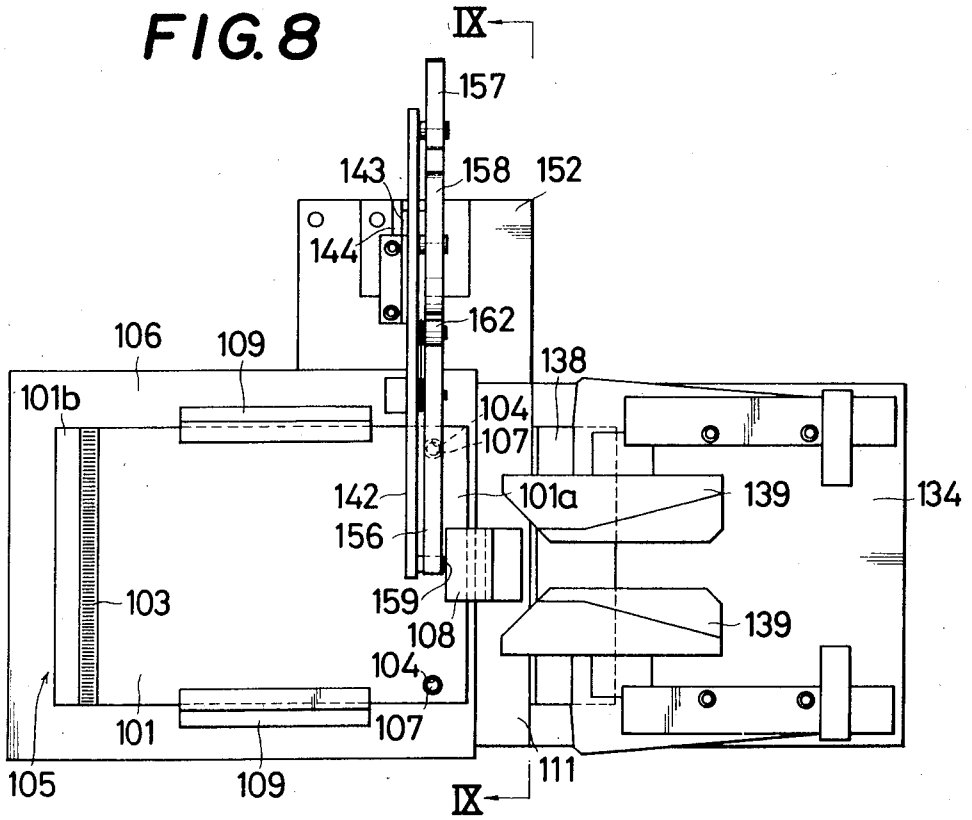
Figure 9:
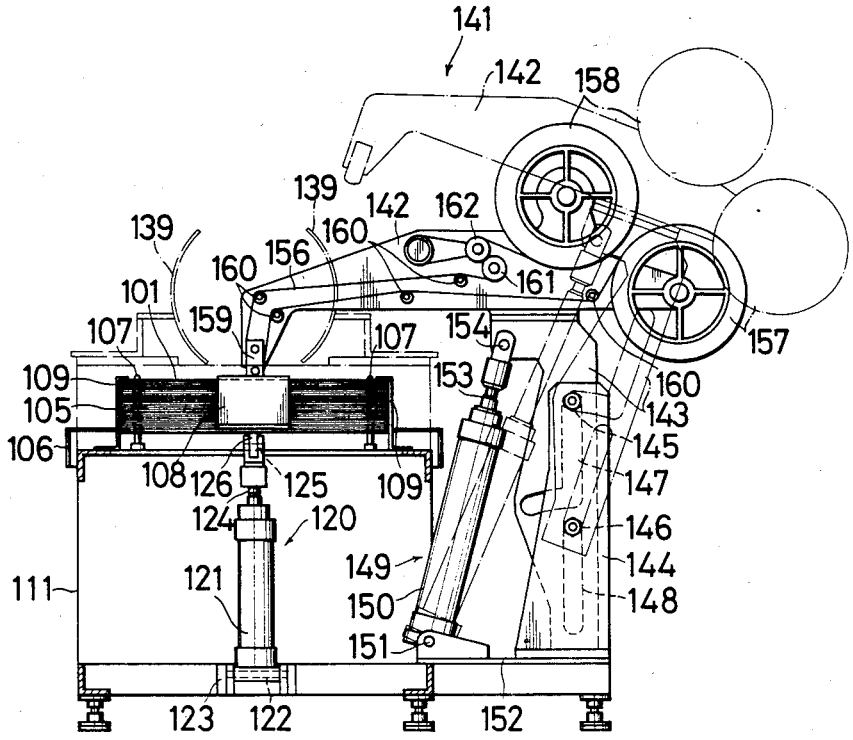

Referring to FIGS. 7 to 9, a bag table 106 is mounted on a rear frame 111, on which a unit of piled bags 105 is placed, each of which has a mouth or opening 102 at one end 101*a* and a seal 103 at the other end 101*b*.

The lower surface of the rear end of the bag table 106 is mounted to a mounting portion 113 of the rear frame 111 through hinges 112, and is vertically pivotal about a pivot pin 114 of the hinges 112. Holding pins 107 and a press plate 108 are respectively fixed to an upper horizontal plate 115 of the rear frame 111. The holding pins 107 extend upward through a pair of right and left insertion holes 116 formed at the front end of the bag table 106. Adjustment screws 117 are respectively mounted at the lower ends of the holding pins 107 so as to allow adjustment of their hight.

A pressing means 119 for exerting a variable upward pressure on the bag table 106 is mounted therebelow. The pressing means 119 comprises, for example, a vertically arranged air cylinder 120. The lower end 121 of the air cylinder 120 is pivotally mounted on a mounting portion 123 of the rear frame 111 through a pivot pin 122. The upper end of a piston rod 124 of the air cylinder 120 is pivotally mounted through a pivot pin 125 on a mounting portion 126 fixed to the lower surface of the bag table 106. In a compressed air supply path from a compressed air supply such as an air compressor 128 to the air cylinder 120 are arranged a solenoid operated valve 129 and a pair of pressure control valves 130 and 131 set to a high and a low pressure, respectively. The pressure control valves 130 and 131 may be switched by the solenoid operated valve 129.

The upper horizontal plate 134 of a front frame 133 is fixed at substantially the same level as that of the press plate 108. In the front frame 133, a blower 135 is mounted below the upper horizontal plate 134, and its supply opening 136 opens toward the rear. Air ejected from the supply opening 136 is guided by an air guide 137 mounted below the upper horizontal plate 134 and is blown toward the mouths 102 of the plastic bags 101 through an opening 138 formed substantially at the center of the rear end of the upper horizontal plate 134. A pair of solid article insertion guides 139 which are of arcuate shape and which oppose each other are formed at the two sides of the upper surface of the upper horizontal plate 134.

As shown in FIG. 9, a pickup mechanism 141 is arranged at one side of the rear frame 111. A pickup arm 142 of the pickup mechanism 141 is supported through a support arm 143 extending vertically from the lower portion of the pickup arm 142. A support base 144 is vertically arranged on a mounting portion 152 at one side of the rear frame 111. A pair of vertically disposed guide rollers 145 and 146 are mounted on the support base 144. The guide rollers 145 and 146 respectively engage a pair of vertical upper and lower guide grooves 147 and 148 of a substantially L-shape and of a vertical shape, respectively, formed in the support arm 143. A lower end 150 of an air cylinder 149 is pivotally mounted on a mounting portion 152 through a pivot pin 151. The upper end of a piston rod 153 is coupled to the upper portion of the support arm 143 by a pivot pin 154. Upon operation of the air cylinder 149, the pickup arm 142 is vertically reciprocated along with the support arm 143 between a bottom dead point indicated by the solid line and a top dead point indicated by the broken (imaginary) line in FIG. 9. By the guiding operation of the L-shaped and vertical guide grooves 147 and 148, the pickup arm 142 is raised once and is then pivoted clockwise (FIG. 9) about the lower guide roller 146 to be moved to the top dead point. Thus, the pickup arm 142 is reciprocated along the vertical path.

An adhesive tape 156 is used as a pickup means. A supply reel 157 with the adhesive tape 156 wound thereon and a take-up reel 158 for taking up the tape from the supply reel 157 are detachably mounted on the rear side of the picukup arm 142. A pickup head 159 is mounted on the distal end of the pickup arm 142. The adhesive tape 156 drawn from the supply reel 157 is passed through a plurality of guide rollers 160 mounted at various positions on the pickup arm 142 and through a pair of pinch rollers 161 and 162 onto the take-up reel 158. The adhesive side of the adhesive tape 156 faces downward from the outer surface of the pickup head 159. An intermittent drive mechanism (not shown) is operated for one cycle upon every reciprocal movement of the pickup arm 142 so as to rotate intermittently the pinch roller 162 and the take-up reel 158. In this manner, the adhesive tape 156 is intermittently drawn by a constant amount from the supply reel 157 onto the pickup head 159 and is wound onto the take-up reel 158. A brake (not shown) for preventing extra supply of the adhesive tape 156 due to its inertia is mounted on the supply reel 157.

The bag cassette-type loader of the second embodiment of the present invention has the configuration described above. The pickup of the plastic bag 101 and the filling of the picked up plastic bag 101 with the solid article 164 such as ham will now be described with reference to FIGS. 10A to 10D and 11A to 11D.

The unit of piled bags 105 is placed on the bag table 106, and the holding pins 107 are inserted into the through holes 104 of its plastic bags 101 from below, and if necessary, the unit 105 is positioned also with a pair of positioning members 109. The bag table 106 is biased or urged upward by the air cylinder 120. The central portion of the mouth end of the unit 105 having the mouths 102 is urged against the lower surface of the press plate 108, as shown in FIG. 9. Air from the blower 135 is blown against the mouth end of the unit 105 having the mouths 102. At this time, the solenoid operated valve 129 is connected to the side of the pressure control valve 130 which is set to supply high pressure. Therefore, the urging force of the air cylinder 120 is strong, and the plastic bags 101 are not be blown away by the airstream.

Figure 11A:
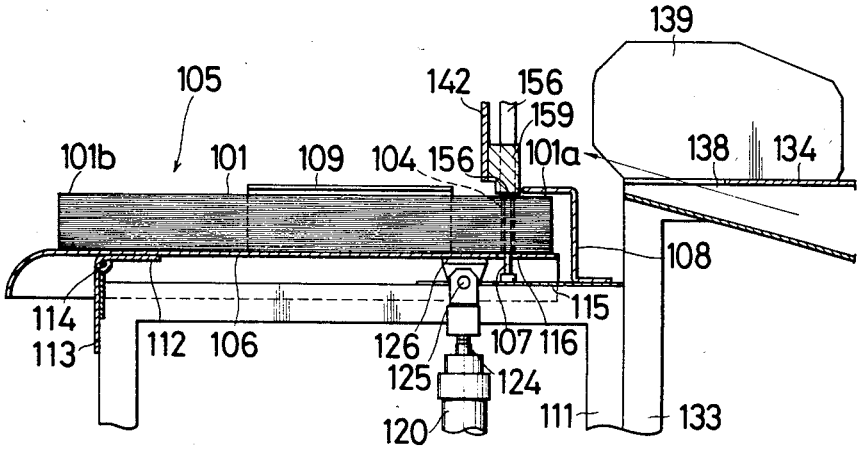

When a start switch such as a manual switch or a foot switch is subsequently depressed, the pickup arm 142 is lowered as shown in FIGS. 10A and 11A. The adhesive tape 156 is urged against the upper surface of the one end 101*a* of the uppermost plastic bag 101 of the unit 105 by the pickup head 159.

Figure 11B:
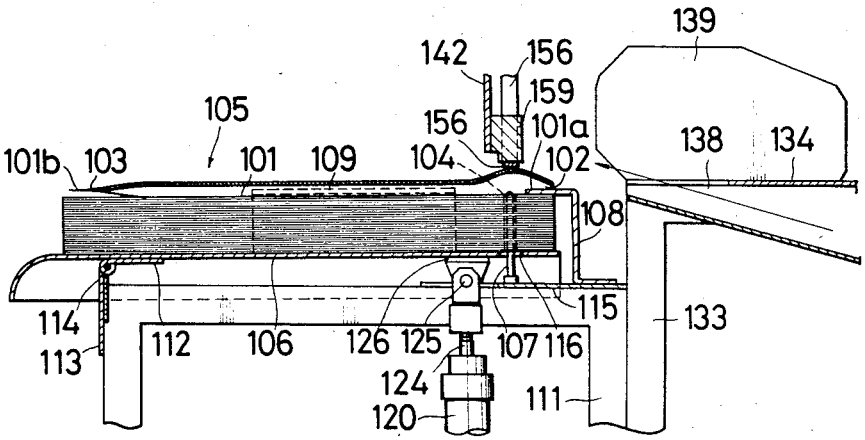

Subsequently, the pickup arm 142 is raised as shown in FIGS. 10B and 11B. Then, the upper surface of the uppermost plastic bag 101 is lifted by adhesion to the adhesive tape 156. The upper surface of the one end 101*a* of the plastic bag 101 having the mouth 102 is pulled out from a position below the press plate 108, and the mouth 102 is fully opened as the pickup arm 142 is raised.

The adhesive tape 156 is urged against the upper surface of the pickup head 159, and the solenoid operated valve 129 is temporarily connected to the side of the pressure control valve 131 which is set to supply low pressure so as to temporarily weaken the urging force of the air cylinder 120. While the urging force of the air cylinder 120 is temporarily weakened in this manner, the upper surface of the uppermost plastic bag 101 is pulled upward by the adhesive tape 156, so that the upper surface of the one end 101*a* of the plastic bag 101 may be easily pulled out from a position beneath the press plate 108. Immediately after this pulling out operation, the solenoid operated valve 129 is reconnected to the side of the pressure control valve 130 set to supply high pressure. The urging force of the air cylinder 120 is therefore increased again, and the lower surface of the one end 101*a* of the uppermost plastic bag 101 and the underlying plastic bags 101 are strongly urged upwardly against the lower surface of the press plate 108. The switching of the solenoid controlled valve 129 described above may be realized by various methods. For example, a timer may be used to control the solenoid valve after the passage of a time period set by such a timer after the start switch is turned on. Another method may be adopted wherein the solenoid operated valve 129 is energized for a predetermined time period measured from detection, by a limit switch or the equivalent, of the movement of the vertically reciprocating pickup arm 142.

Figure 11C:
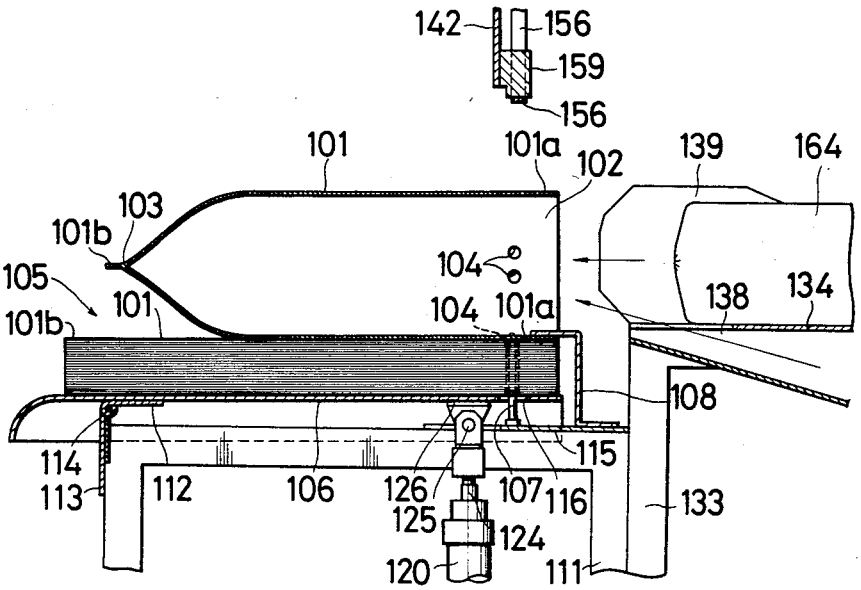

When the mouth 102 of the uppermost plastic bag 101 is slightly opened, the air blown from the blower in the manner described above enters inside the plastic bag 101. The plastic bag 101 is inflated with air and expanded into a cylindrical shape to have a circular mouth 102, as shown in FIGS. 10C and 11C. As the plastic bag 101 is inflated into a cylindrical shape, the through holes 104 become disengaged from the upper ends of the holding pins 107. Since the urging force of the air cylinder 120 at this time is strong, the lower surface of the one end 101*a* of the uppermost plastic bag 101 is strongly clamped beneath the press plate 108. Thus, the plastic bag 101 is securely held on the unit 105 and may not be blown away be the airstream.

Figure 11D:
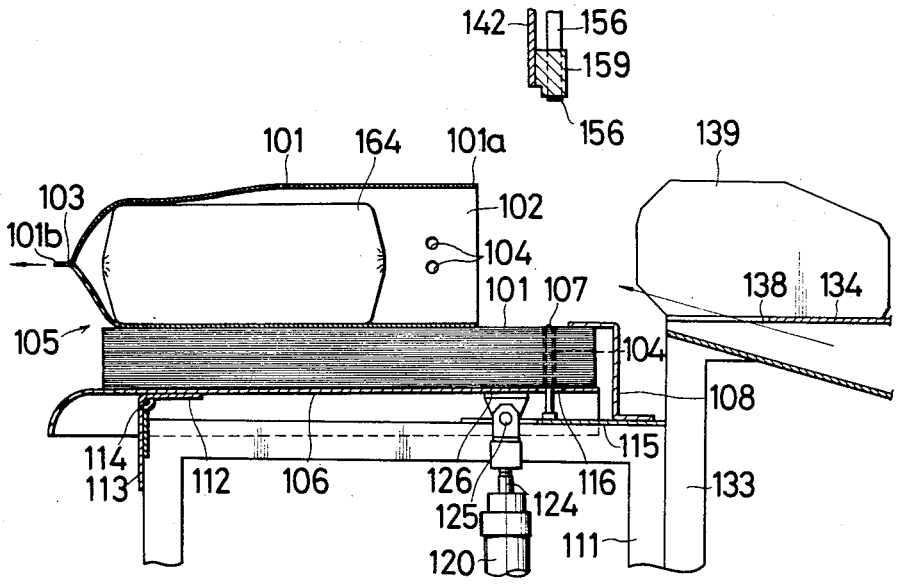

While the mouth 102 of the uppermost plastic bag 101 is fully opened as described above, the solid article 164 such as ham is guided by the insertion guides 139 into the plastic bag 101, as shown in FIGS. 10C and 11C. Due to the impact of the solid article 164, the lower surface of the one end 101*a* of the plastic bag 101 is pulled out of its position beneath the press plate 108 as shown in FIGS. 10D and 11D. The plastic bag 101 is then conveyed together with the solid article 164 to the next step such as a packing step.

The packing device according to the second embodiment of the present invention has the configuration and the mode of operation as described above. The packing device may be used alone or in comination with feed-in and feed-out conveyors for ham or the like in a vacuum packing line. In the latter case, automatic vacuum packing of ham or the like inside the plastic bags 101 may be performed by turning on the start switch as described above according to the feed condition of the ham.

Although the present invention has been described with reference to two embodiments thereof, various other modifications and changes may be made within the spirit and scope of the present ivnention. For example, the support and press mechanisms of the bag table, the holding means, the press member, the pickup mechanism and associated mechanisms may be modified. For example, the press mechanism may have a hydraulic cylinder apparatus. The method for temporarily decreasing the urging force of the cylinder apparatus may be other than that described above involving switching of the pressure control valves. For example, a method may alternatively be adopted wherein a relief valve is used to temporarily decrease the pressure inside the cylinder. The pickup means is not limited to the adhesive tape described with reference to the second embodiment and may alternatively be a vacuum suction head. The present invention is widely applicable to packing apparatuses for packing solid articles of various types into plastic bags.

What is claimed is:

1. A packing device using a unit of bags consisting of a plurality of plastic bags piled, each having upper and lower surfaces sealed to one another to define a mouth end and a sealed end, comprising:

(a) a bag table which is mounted on a frame, at least one end of said bag table being vertically movable, on which said unit of bags is placed;

(b) a hydraulic cylinder for pressing said at least one end of said bag table upwardly;

(c) a press member fixed to said frame for pressing relatively downwardly against the mouth end of said unit of bags, said unit of bags being pressed upwardly against said press member together with said bag table by said hydraulic cylinder;

(d) a blower fixed to said frame for blowing gas toward the mouth end of said unit of bags;

(e) pickup means, mounted to said frame, for being controllably urged against the upper surface of the uppermost bag in said unit of bags at its mouth end and for being subsequently lifted to pick up the upper surface of said bag and open the mouth thereof; and (f) means for synchronizing the urging and lifting of said pickup means with reduction of the upward pressure exerted by said unit of bags against said press member, whereby the mouth end of said upper surface of said uppermost bag is released by said press member substantially simultaneously with the lifting of said upper surface of said uppermost bag, said synchronizing means comprising a pressure control circuit having at least two pressure control valves capable of supporting high or low hydraulic pressure to said hydraulic cylinder and having solenoid means for controlling the hydraulic pressure supplied by said valves to said hydraulic cylinder.

2. A packing device according to claim 1 wherein said blower comprises a blower to blow air.

3. A packing device according to claim 1, further comprising stationary paired holding means arranged for holding two portions of the mouth end of said unit on either side of said press member.

4. A packing device according to claim 3 wherein said stationary holding means comprises a pair of vertical holding pins fixed to said frame to pass through holes in said unit of bags.

5. A packing device according to claim 1, wherein said bag table is pivoted to swing up and down on pivot pins located on said frame at an end thereof opposed to end of said frame above which the mouth end of said unit is located.

6. A packing device according to claim 1, further comprising a gas guide for guiding gas from said blower toward the central portion of the mouth end of said unit.

7. A packing device according to claim 1 wherein said bag table further comprises a pair of right and left positioning members to position each of longitudinal sides of said unit placed on said bag table.

8. A packing device according to claim 1, wherein said hydraulic cylinder comprises an air cylinder.

9. A packing device according to claim 1, further comprising solid article insertion guides arranged on said frame to guide a solid article toward the mouth of said uppermost bag, in accordance with operation of said pickup means to open said uppermost plastic bag, whereby said plastic bag is charged automatically with the solid article.

* * * * *

UNITED STATES PATENT AND TRADEMARK OFFICE

CERTIFICATE OF CORRECTION

PATENT NO. : 4,567,715

DATED : February 4, 1986

INVENTOR(S) : Yuji Sawa and Toshio Itoh

It is certified that error appears in the above-identified patent and that said Letters Patent is hereby corrected as shown below:

Column 2, line 54, change "bag cassette" to read -- unit --

Column 2, line 57, change "5" to read -- 6 --

Column 2, line 57, after "may" insert -- be --

Column 4, line 3, change "toss" to read -- insert --

Column 4, line 19, change "invetnion" to read -- invention --

Column 4, line 35, change "hight" to read -- height --

Column 7, line 4, change "comination" to read -- combination --

Signed and Sealed this

*Twenty-seventh* Day of *May 1986*

[SEAL]

*Attest:*

DONALD J. QUIGG

*Attesting Officer*

*Commissioner of Patents and Trademarks*